US005205013A

United States Patent [19]

Lopes

[11] Patent Number: 5,205,013

[45] Date of Patent: Apr. 27, 1993

[54] COMBINED DECORATIVE STORAGE HOUSING AND VACUUM CLEANER

[75] Inventor: Gene Lopes, Sacramento, Calif.

[73] Assignee: Flash Vac Inc., Sacramento, Calif.

[21] Appl. No.: 750,067

[22] Filed: Aug. 26, 1991

[51] Int. Cl.[5] ..... A47L 5/38

[52] U.S. Cl. ..... 15/301; 15/310; 15/323; 15/326; 248/146

[58] Field of Search ..... 15/301, 323, 310, 336; 248/146

[56] References Cited

U.S. PATENT DOCUMENTS

| | | | |
|---|---|---|---|
| 2,367,437 | 1/1945 | Salt | 15/323 |
| 3,027,587 | 4/1962 | Bierstock | 15/301 |
| 3,027,588 | 4/1962 | Bierstock | 15/301 |
| 3,254,359 | 6/1966 | Coll | 15/323 X |

FOREIGN PATENT DOCUMENTS

| | | | |
|---|---|---|---|
| 675552 | 12/1963 | Canada | 15/301 |
| 2101472 | 1/1983 | United Kingdom | 15/301 |

*Primary Examiner*—Chris K. Moore
*Attorney, Agent, or Firm*—Mark C. Jacobs

[57] ABSTRACT

A combined vacuum cleaner storage housing and foot operated vacuum cleaner for use in salons to dispose of cut hair. The apparatus features a plant storage and display area and is formed of four vertical walls, one of which preferably the rear has an access door therein. The unit sits on a base which has a front opening which communicates with a throat which receives the hair and which in turn communicates with the intake member of a Shop-Vac ® or equal vacuum cleaner disposed within the housing.

20 Claims, 3 Drawing Sheets

COMBINED DECORATIVE STORAGE HOUSING AND VACUUM CLEANER

BACKGROUND OF THE INVENTION

An age old problem of barber shops, hair stylists and pet grooming facilities is what to do with the unsightly hair that accumulates from the cutting operation. Usually it is gathered with a push broom and swept into one corner of the salon. It is then brushed into a dustpan for disposal in the trash. This is a chore that no employee cherishes, since oftentimes loose hair can collect on one's clothes during the disposal operation.

As an alternative, one can utilize a vacuum cleaner to collect the hair, but these instruments are not intended for operation on linoleum floors, which are favored by salons of the type described. Therefore the use of the push broom is favored. Sometimes, the vacuum cleaner is used instead of the dustpan to lift the hair from the floor. This would avoid the bending over chore. But one must still retrieve the vacuum from the storage area of the salon, as these instruments do not add to the decor of the salon if left sitting out.

There is a need therefore for an apparatus that will house a vacuum cleaner in plain sight on the "cutting room floor" and which will itself be aesthetically pleasing and blend with the decor.

It is an object therefore to provide a decorator styled vacuum cleaner housing.

It is another object to provide an easy to use vacuum cleaner for a hair cutting salon.

Yet another object is to provide a quiet unobtrusive vacuum cleaner for use by hair stylists.

Still another object is to provide a combination plant or decorator item display and vacuum cleaner storage chamber.

These and other objects of the invention will in part be obvious and will in part appear hereinafter.

The invention accordingly comprises the apparatus possessing the features, properties and the relation of components which are exemplified in the following detailed disclosure and the scope of the application of which will be indicated in the claims.

For a fuller understanding of the nature and objects of the invention reference should be made to the following detailed description taken in conjunction with the accompanying drawings.

SUMMARY OF THE INVENTION

A combined vacuum cleaner storage housing and vacuum cleaner for use by barbers, hair stylists and pet groomers to dispose of cut hair. The floor upon which the housing is placed, serves as the bottom wall of the throat which receives the hair and which communicates with the nozzle of a Shop-Vac® or equal vacuum cleaner disposed within the housing. The apparatus features a plant storage and display area at the top. The unit has four vertical walls, one of which preferably the rear has an access door therein. The unit sits on a base which has a front opening which communicates with the throat aforementioned. Operation of the vacuum is by a foot switch which for aesthetics emanates from the rear of the apparatus.

DESCRIPTION OF THE PREFERRED EMBODIMENT

Figure 2:
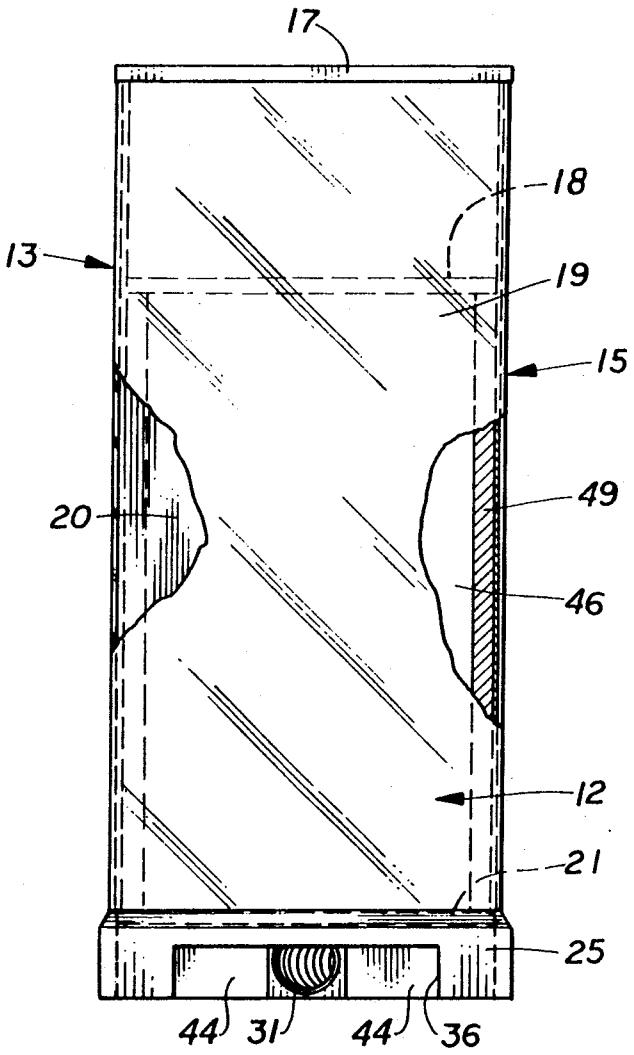
FIG. 2 is a front elevational view thereof.
Figure 1:
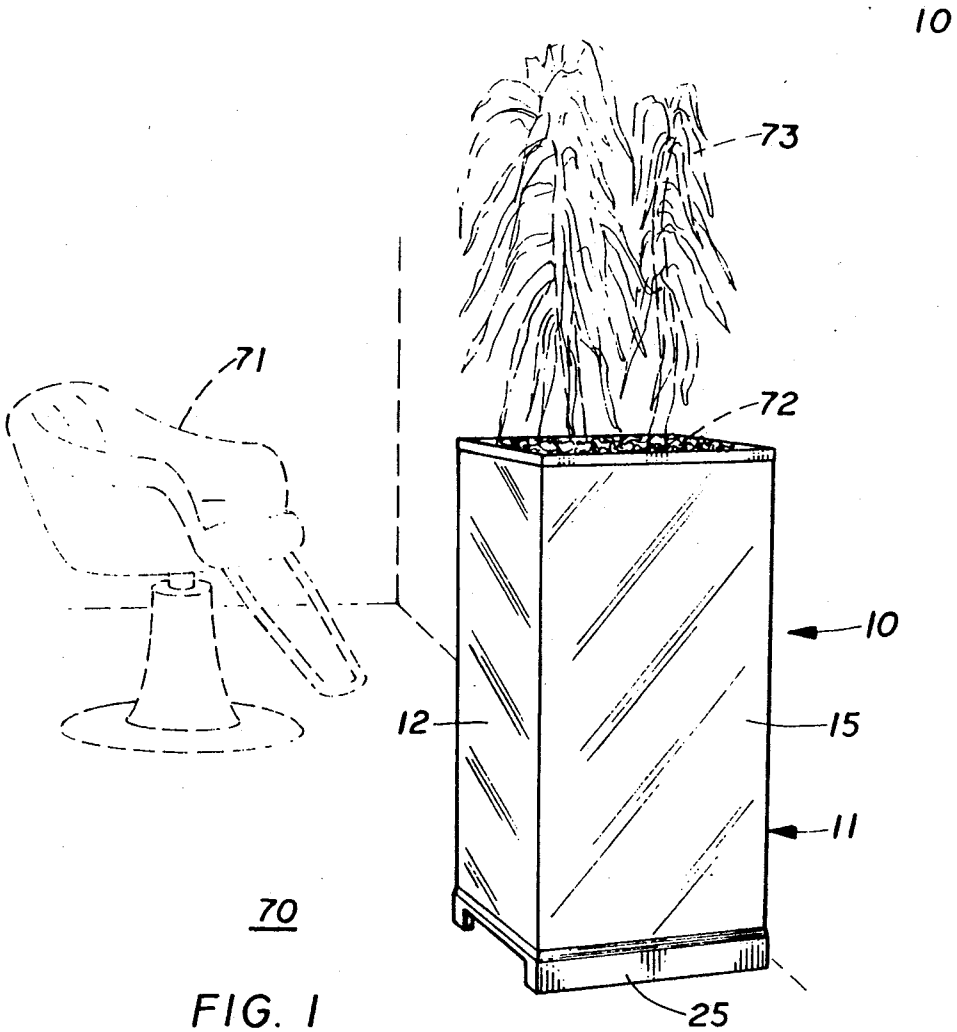
FIG. 1 is a perspective view of the first embodiment of the apparatus of this invention as seen in a typical operational environment.

FIG. 1 depicts the first embodiment 10 of the vacuum cleaner storage housing and vacuum cleaner of this invention disposed upon the floor 70 of a typical hair cutting salon, adjacent a customer's chair 71 and in plain view. Disposed within the top of the apparatus 10 are a plurality of wood chips 72 disposed within a storage area, 22 per FIG. 4, from which extends a pair of preferably silk palm trees. In this view are seen the front wall 12 and the right side wall 15 of the main body 11. Left side wall 13 called out in FIG. 2 is a mirror image of wall 15. Main body 11 sits on a base 25 also visible in FIG. 1.

In FIG. 2, which is a front view of the apparatus, there is shown the main body 11's front wall 12, the spaced side walls 13 and 15 normally disposed thereto and the base 25. Optionally, but preferably the front wall 12, and/or the two side walls 13, 15 may employ a two part construction comprising a subwall 20, usually of wood or perhaps metal or plastic with an overlay 19 of preferably a glass mirror or other laminated material such as Formica® or similar high pressure laminate sheet goods, or even a wood veneer. Since the rear wall usually rests near or against a room wall, it need not have the outer layer or skin of the plastic, mirror or veneer.

Base 25, which is formed of two pairs of spaced members nailed or otherwise joined together at their corners to form a rectangle, is sized to match the cross section of the main body 11, and has a front opening 36. Seen in dashed line is top shelf 18, which is normal to and spaced down from the upper edge of each of the front, side and rear walls. The trim molding 17 is disposed on these upper edges and thus helps to define the storage area 22, seen in FIG. 4. See infra.

Figure 3:
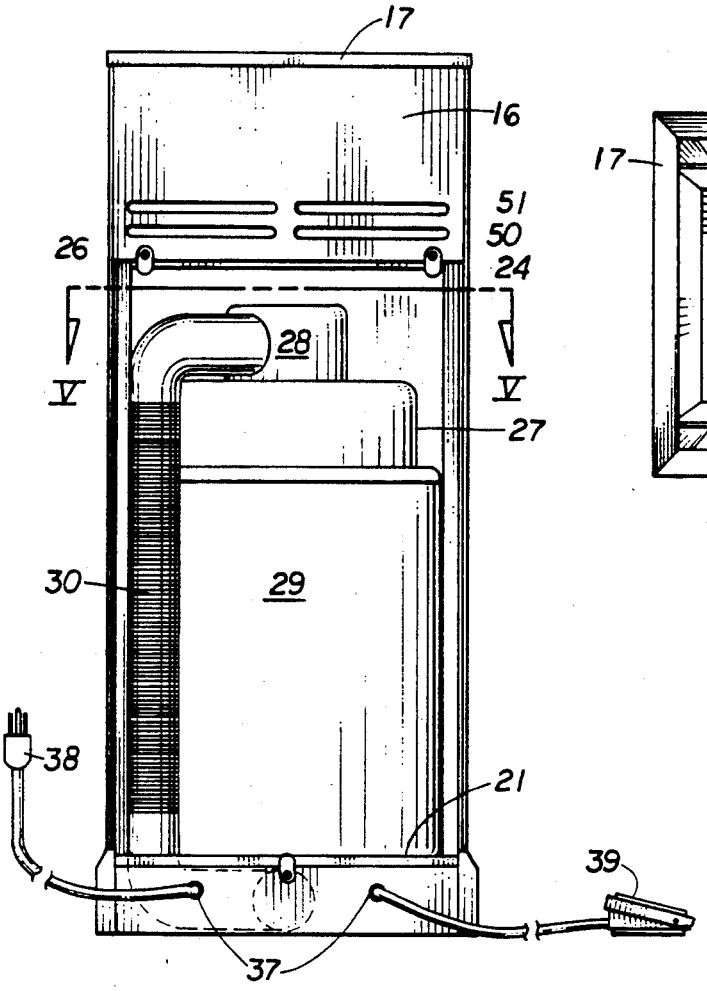
FIG. 3 is a rear elevational view with the access door thereof removed.
Figure 8:
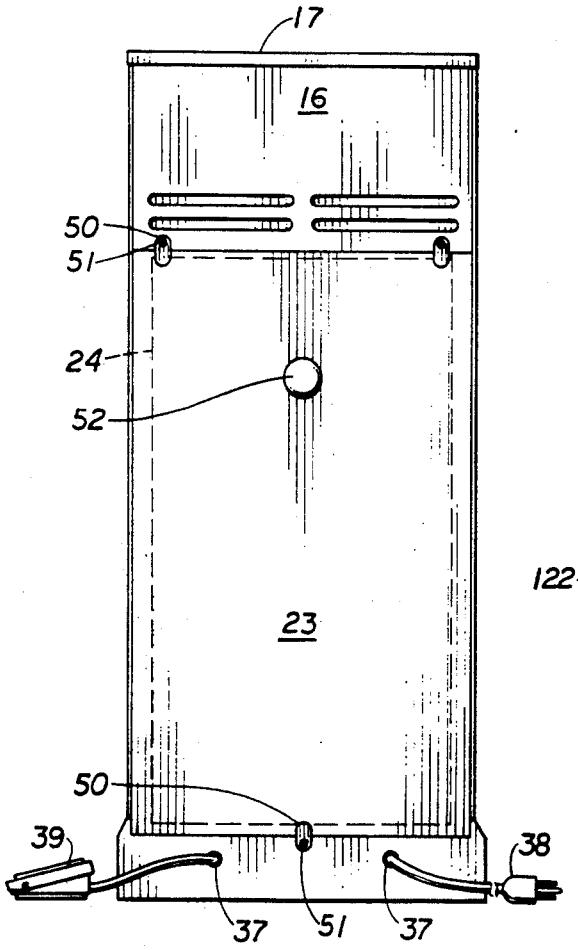
FIG. 8 is a rear elevational view as in FIG. 3, but with the door in place.

The rear view FIG. 3 is the next view to be discussed. Here, rear wall 16, is seen to have a cutout or opening 26 for access to the vacuum cleaner 27 which rests upon the bottom shelf 21 seen in dashed line in FIG. 2. Opening 26 includes a recessed door jamb 24, which serves as a stop for removable door 23 seen in FIG. 8 by being recessed in from the exterior face of the wall a distance equal to the thickness of the door to be placed up against it. This is a conventional door opening carpentry technique.

Vacuum cleaner 27 may be a Shop-Vac® or an equally heavy duty canister-type vacuum. Vacuum 27 is a conventional unit and which comprises a motorized operational head 28 which is removably attached to a dirt receiving canister 29. A flexible hose 30 frictionally engaged to, and in fluid communication with head 28 on one end extends downwardly within main body 11 to the bottom shelf 21. Shelf 21 has an opening 34, or if desired a mere cutout, through which extends the intake opening 31. Flexible hose 30 on its distant end is frictionally engaged to and in fluid communication with intake opening 31. Such unions are conventional. See also FIG. 6.

Figure 4:
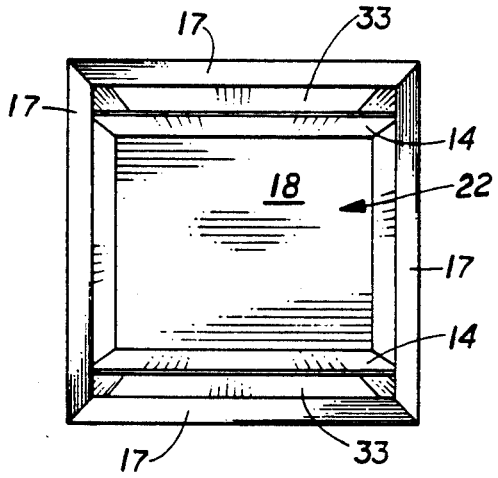
FIG. 4 is a top perspective view thereof.

The reader is now referred to the top perspective view FIG. 4 wherein the storage area 22 is seen. Its use is for one or more preferably silk plants, as shown. Storage area 22 is defined by the upper surface of the plant (top) shelf 18 and a pair of spaced divider members 14 which while shown running horizontally could run from front to back if desired and which are disposed at or near the leading and trailing edges of the shelf 18. As shown, the divider members 14 are stapled or otherwise secured to the shelf 18 and to the two side walls 13, 15. Each divider member is seen to be spaced a few inches from its respective front or rear wall to thereby provide a downward extending slot 33 which communicates with interior 46 for airflow. Thus heat, which occurs from the vacuum head during periods of operation, can rise and escape to the atmosphere through the aforementioned slots.

While a moisture nonpermeable top shelf 18 and divider members 14 are contemplated, for the sake of safety it is urged that only silk or plastic plants be disposed within the storage area 22 to avoid the necessity of adding water which could if Murphy's law is followed, drip down onto the vacuum cleaner and cause damage.

Figure 5:
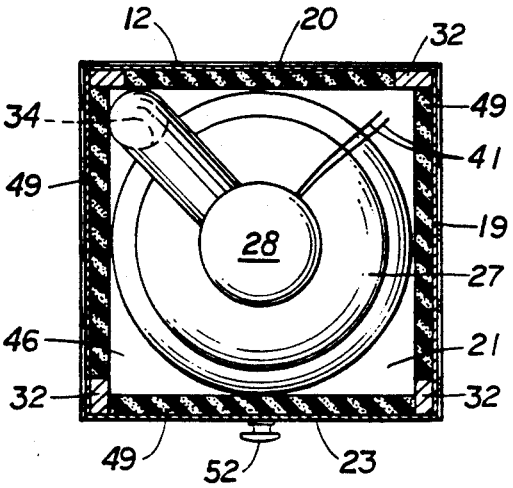
FIG. 5 is a sectional view taken along the line V—V of FIG. 3.

We now turn to FIG. 5, which is a sectional view taken along the line III—III of FIG. 3 just below the top shelf 18. Thus vacuum 27 is seen to be disposed upon bottom shelf 21 within interior 46.

Each of the front two corners may include an optional stiffener 32 in the form of a 1×2 beam member running vertically with the subwall material 20 disposed therebetween. However from the point of view of construction, it may be easier to utilize the stiffeners only between the floor and the bottom shelf 21 ie. within the base 25.. These stiffeners would help define the opening 36 which communicates with the throat 45 leading to nozzle 31 per FIG. 6.

Figure 6:
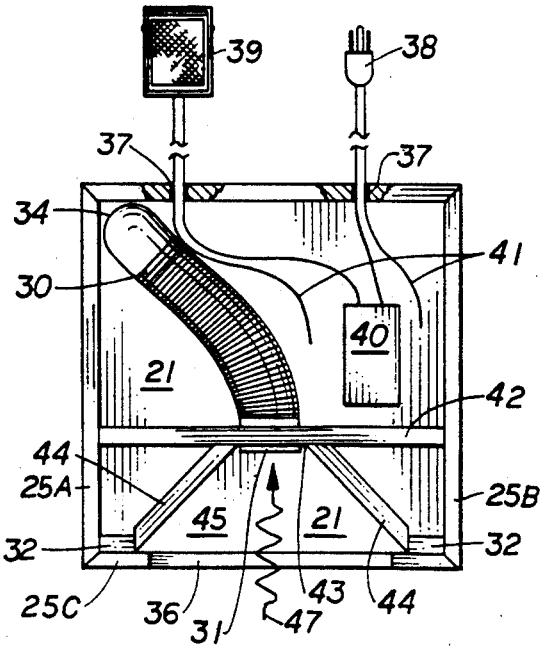
FIG. 6 is a bottom plan view of the invention.
Figure 7:
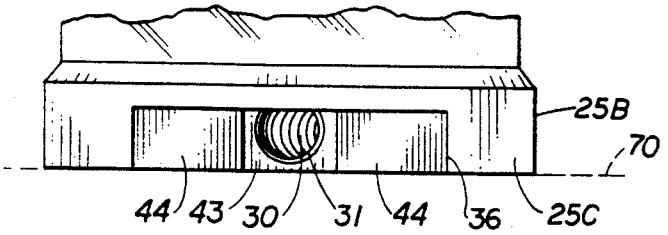
FIG. 7 is a close-up elevational view of the lower area of the front of this apparatus.

In FIG. 6, which is a bottom plan view, the area beneath the second shelf 21, is seen. Here, a cross brace 42 is disposed between the two sides, 25A and 25B of the base, slightly distant from the midpoint along the depth of the sides. Cross brace 42 may also be connected to the underside of bottom shelf 21. Cross brace 42 includes a central opening 43 into which is fitted the distal end of intake opening 31, its proximal end being engaged as previously note the flexible tubing 30. See FIG. 3. A pair of diverging, throat-defining members 44, are each connected on one end to opposite sides of opening 43, and on their other ends to the optional stiffeners 32 if employed, or to the front 25C of said base. Thus a path that leads directly to intake opening 31 is seen to have been created, with the floor acting as the bottom surface, and the bottom shelf 21 serving as the upper part of this enclosure. Wavy arrow 47 symbolizes the hair that would enter through opening 36 into the throat 45 and onward to the intake opening 31 on its way to the canister 29.

Operation of the vacuum 27 is controlled by a conventional toe pedal actuator 39 connected electrically in line with an optional thermal sensor 40, which is also electrically connected to the line cord 41. One of each of the two ends of the line cord and the toe pedal actuator line 41 to the vacuum 27 are conventionally attached, but in the current figure they are shown unconnected for ease of depiction. A standard plug 38 is shown at the external end of the line cord 41. See also FIG. 5. Rear wall 16 is seen to include at least one opening 37 though which pass the wires for 39 and 41. Such openings are normally in the base 25 of the apparatus.

FIG. 8 again depicts the rear wall 16 shown with its top molding trim 17. Here, however, door 23 is shown installed in place up against door jamb 24. Door 23 is retained in place by rotatable retainer tabs 50, which are each held against wall 16 by a single screw 51. It is readily seen that rear wall 16 need not require the placement of an overlay such as a mirror or high pressure laminate since it normally rests against a wall and is seen only during such time as it is necessary to empty vacuum 47, at which time the unit 10, is moved away from the wall. A handle or knob 52 is shown centrally positioned on door 23. It is within the skill of the art to replace upper retainers 50 with conventional hinges if desired.

Figure 9:
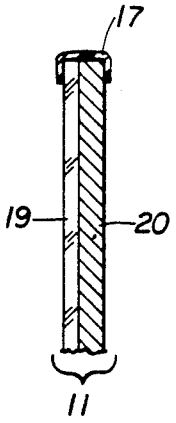
FIG. 9 is a close-up diagrammatic view which illustrates the mode of construction of the apparatus of this invention.

FIG. 9 serves to merely recap the preferred mode of construction that has been previously discussed. Thus a typical wall is seen to comprise a skin such as a mirror 19 adhesed to a wood or other material subwall 20. To prevent someone from being cut by the mirror edge and to hide the end grain, as well as to enhance the aesthetics, a cap molding 17 may be overlaid on the combined edges of 19 and 20. Molding 17 may be frictionally fit or adhesed into place. Solid wall construction without the use of a skin for the two side and front walls is also contemplated.

Figure 10:
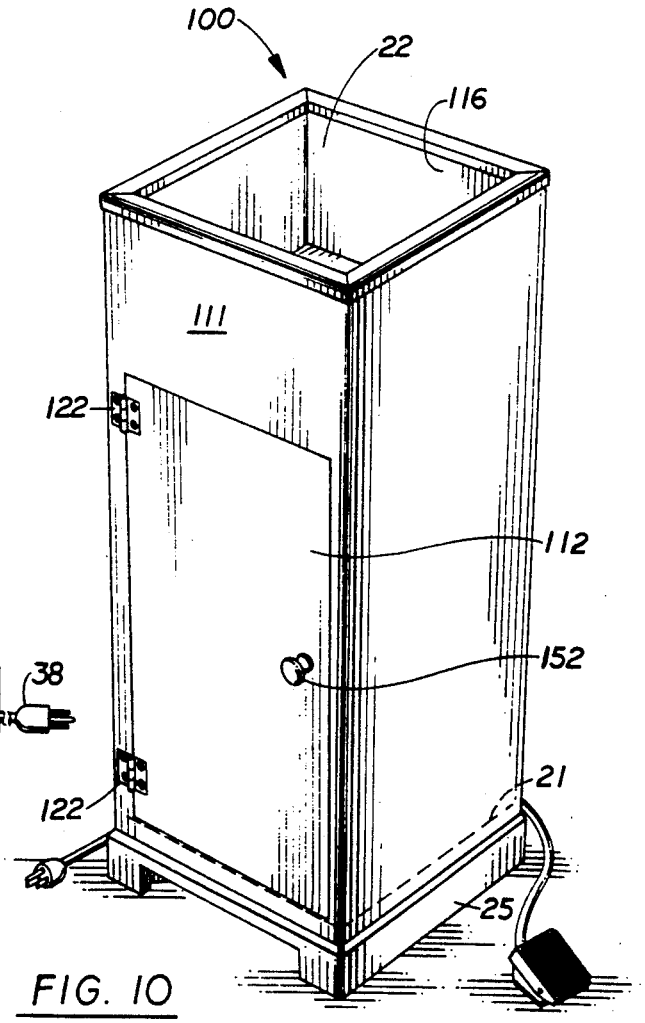
FIG. 10 is a front perspective view of a second embodiment of this invention.

FIG. 10 depicts a second embodiment 100, of this invention. Here the front wall 111 has the access door 112. Door 112 is retained in place by side mounted hinges 122, and is opened by knob 152. Base 25 and the elements found between the bottom shelf 21, shown in dashed line, and the floor are the same as in the first embodiment. Storage area 22 is also the same as in the first embodiment. Rear wall 116 need not have an access door in view of the accessibility to the vacuum through front door 112.

From a sizing point of view, I have found that a unit having a width of about 14 inches, a depth of about the same amount and an overall height of about 2 feet 8 inches is aesthetically pleasing. A unit sized as such will fit easily through doors and will accommodate the preferred model vacuum cleaner recited above. Obviously, if a smaller capacity vacuum is used a generally smaller unit could be built. Larger units are also contemplated.

While the embodiments described above both include a separate base section, it is recognized of course that the base can be integral with and a part of the side, front and rear walls. The use of a separate base is seen to be preferred, since the preferred skin over the wood subwall is glass mirrors. By not having the glass touch the floor, breakage due to impact with brushes, toes, or other implements can be avoided.

While not required, it is preferred to line the interior 46 of the unit (FIG. 2) with a sound deadening material 49, as by stapling it to the interior of the housing's walls 13, 15, and 11 and perhaps the rear wall as well. Such material is called out in the right cutaway of FIG. 2.

While the two embodiments shown have the doors that access the interior on either the front or rear wall, obviously if desired, the access door could be placed in one of the side walls.

A brief reference is made back now to FIG. 4. While the two divider members have been shown to be both spaced from the wall to which it is adjacent, it is within the contemplation of the inventor to provide only one of these dividers in a spaced relationship from its adjacent wall. This would provide an off center storage shelf with one large slot and one either small or non-existent slot, depending upon where the divider in question is disposed. Books or implements of the trade can be retained hidden from general view within the storage area rather than the artificial plants shown in FIG. if so desired.

Since certain changes may be made in the above apparatus without departing from the scope of the invention herein involved, it is intended that all matter contained in the above description and shown in the accompanying drawings shall be interpreted as illustrative and not in a limiting sense.

I claim:

1. A combined vacuum cleaner storage housing and vacuum cleaner for use by barbers, hair stylists and pet groomers to dispose of cut hair which comprises:

a. a main body having an interior and an exterior, said body being formed from spaced generally vertical front, and rear walls and spaced side walls normal thereto, one of which includes an access door to the interior thereof;

b. a storage area formed in the top of said body and defined by (I) a generally horizontally disposed top shelf, the extent of which in one direction is less than the distance between one of the two pair of opposed spaced walls of the main body, and (II) a pair of spaced parallel upstanding divider members attached to said shelf and two of said walls, c. a second shelf spaced down from the top shelf disposed within the interior for receipt of a canister vacuum cleaner said second shelf having an opening therein for disposition of one end of a canister vacuum cleaner intake member;

d. a throat defined by a cross brace disposed beneath said second shelf, which cross brace has an opening, and a pair of diverging throat definers which extend from opposite sides of said cross brace opening;

e. a canister vacuum intake member disposed between said central opening of said throat and the opening in said second shelf;

f. a canister vacuum disposed on said second shelf;

g. means fluidly connecting said canister vacuum to said intake member wherein one of said vertical walls has a bottom opening fluidly communicating the space outside of said storage housing with said cross brace opening.

2. The combined storage housing and vacuum cleaner of claim 1 wherein the main body sits on a base having an opening therein, said bottom opening passing through said base and fluidly communicating the space outside of said storage housing with and said throat;

3. The combined storage housing and vacuum cleaner of claim 1 wherein the base is integral to the main body.

4. The combined storage housing and vacuum cleaner of claim 1 wherein at least three of the walls comprise a subwall and skin applied thereto.

5. The combined storage housing and vacuum cleaner of claim 4 wherein each of the subwall and the skin have an upper edge, both of which upper edges are overlaid with a trim molding.

6. The combined storage housing and vacuum cleaner of claim 4 wherein the skin applied is a mirror.

7. The combined storage housing and vacuum cleaner of claim 1 wherein the access door to the interior is in the rear wall.

8. The combined storage housing and vacuum cleaner of claim 1 wherein the access door to the interior is in the front wall.

9. A combined vacuum cleaner storage housing and vacuum cleaner for use by barbers, hair stylists and pet groomers to dispose of cut hair which comprises:

a. a main body having an interior and an exterior, said body being formed from spaced generally vertical front, and rear walls and spaced side walls normal thereto, the rear one of which includes an access door to the interior thereof;

b. a storage area formed in the top of said body and defined by (I) a generally horizontally disposed top shelf, the extent of which in one direction is less than the distance between one of the two pair of opposed spaced walls of the main body, and (II) a pair of spaced parallel upstanding divider members attached to said shelf and two of said walls, c. a second shelf spaced down from the top shelf disposed within the interior for receipt of a canister vacuum cleaner said second shelf having an opening therein for disposition of one end of a canister vacuum cleaner nozzle;

d. a throat defined by a cross brace disposed beneath said second shelf, which cross brace has an opening, and a pair of diverging throat definers which extend from opposite sides of said opening of said throat to a base;

e. a canister vacuum intake member disposed between said central opening of said throat and the opening in said second shelf;

f. a canister vacuum disposed on said second shelf;

g. means fluidly connecting said canister vacuum to said intake member h. said base having an opening therein in fluid communication with the opening of said throat.

10. The combined storage housing and vacuum cleaner of claim 9 wherein at least three of the walls comprise a subwall and skin applied thereto.

11. The combined storage housing and vacuum cleaner of claim 9 wherein the skin applied is a mirror; and each of said walls has an upper edge, and wherein a trim molding overlies said edges.

12. The combined storage housing and vacuum cleaner of claim 1 wherein the interior is lined with sound deadening insulation.

13. The combined storage housing and vacuum cleaner of claim 8 wherein the front door is hingedly secured in place and has a handle thereon.

14. The combined storage housing and vacuum cleaner of claim 10 wherein the interior is lined with sound deadening insulation.

15. A vacuum cleaner storage housing for a vacuum cleaner for use by barbers, hair stylists and pet groomers to dispose of cut hair which comprises:

a. a main body having an interior and an exterior, said body being formed from spaced generally vertical front and rear walls, and spaced side walls normal thereto, one of which walls includes an access door to the interior thereof and one of said walls including an opening at the bottom thereof;

b. a storage area formed in the top of said body and defined by (I) a generally horizontally disposed top shelf, the extent of which in one direction is less than the distance between one of the two pair of opposed spaced walls of the main body, and (II) a pair of spaced parallel upstanding divider members attached to said shelf and two of said walls, c. a second shelf spaced down from the top shelf disposed within the interior for receipt of a canister vacuum cleaner said second shelf having an opening therein for disposition of one end of a canister vacuum cleaner intake member;

d. a throat defined by a cross brace disposed beneath said second shelf, which cross brace has an opening, and a pair of diverging throat definers which extend from opposite sides of said opening of said throat to the opening at the bottom of one of which vertical walls.

16. The storage housing for a vacuum cleaner of claim 15, wherein at least three of the walls comprise a subwall and skin applied thereto.

17. The storage housing for a vacuum cleaner of claim 16, wherein each of the subwall and the skin have an upper edge, both of which upper edges are overlaid with a trim molding.

18. The storage housing for a vacuum cleaner of claim 17, wherein the skin applied is a mirror.

19. The storage housing for a vacuum cleaner of claim 15 wherein the access door to the interior is in the rear wall; and wherein at least three of the walls comprise a subwall and skin applied thereto.

20. The storage housing for a vacuum cleaner of claim 16, wherein each of the subwall and the skin have an upper edge, both of which upper edges are overlaid with a trim molding.

* * * * *